United States Patent [19]

Ashton et al.

[11] 4,371,055

[45] Feb. 1, 1983

[54] METHOD OF MANUFACTURING A FIBERGLASS LADDER

[75] Inventors: Larry J. Ashton, Mapleton; Ronald R. Grimes, Provo, both of Utah

[73] Assignee: Little Giant Industries, Inc., Provo, Utah

[21] Appl. No.: 204,745

[22] Filed: Nov. 7, 1980

[51] Int. Cl.[3] ..... E06C 1/18; E06C 1/32; E06C 7/08

[52] U.S. Cl. ..... 182/46; 182/194; 182/23; 182/104; 65/11.1; 156/166

[58] Field of Search ..... 182/46, 47, 194, 219, 182/23, 104; 65/11 W; 156/166, 167, 193

[56] References Cited

U.S. PATENT DOCUMENTS

| | | | |
|---|---|---|---|
| 2,749,265 | 6/1956 | Eldred | 154/90 |
| 2,885,132 | 5/1959 | Campbell | 182/46 |
| 2,932,358 | 4/1960 | Hopfeld | 182/46 |
| 2,936,848 | 5/1960 | Hall | 182/46 |
| 3,031,360 | 4/1962 | Currier | 156/167 |
| 3,085,649 | 4/1963 | Gillman | 182/46 |
| 3,467,507 | 5/1966 | Andreevskaya et al. | 65/11 |
| 3,651,188 | 4/1969 | Wolf | 264/136 |
| 3,674,110 | 7/1972 | Cooke | 182/46 |
| 4,029,172 | 6/1977 | Green | 182/46 |
| 4,132,530 | 1/1979 | Booth et al. | 156/193 |
| 4,182,431 | 1/1980 | Wing | 182/23 |

*Primary Examiner*—Reinaldo P. Machado
*Attorney, Agent, or Firm*—H. Ross Workman; Rick D. Nydegger; Allen R. Jensen

[57] ABSTRACT

A combination step and extension ladder manufactured of composite material such as fiberglass is disclosed. The inner and outer side rails are molded fiberglass so that the fibers are angularly oriented with respect to the longitudinal axis of the respective side rail. Hinges are provided on each of the inner side rails of the ladder so that the ladder may be folded and unfolded from a step ladder configuration to a straight extension ladder configuration and vice versa. The inner side rails are telescopically mounted within channeled outer side rails so that the inner side rails can be extended to increase the height of the ladder in either configuration. The outer side rails have a foam strip molded into one side such that the ladder rungs between the outer side rails are supported by both the fiberglass and the foamstrip. The inner side rails are provided with an insert which corresponds to the stepping surfaces of the rungs between the inner side rails to prevent twisting or movement of the rungs and to help to support the weight supported by the rungs.

5 Claims, 6 Drawing Figures

METHOD OF MANUFACTURING A FIBERGLASS LADDER

BACKGROUND

1. The Field Of The Invention

The present invention relates to fiberglass ladders and to their method of manufacture. More particularly, it relates to the manufacture of fiberglass combination step and extension ladders which may be folded and unfolded from a stepladder configuration to a straight extension ladder configuration.

2. The Prior Art

Ladders are commonly used for a variety of applications and are of two general types: (1) a folding ladder, commonly called a stepladder, which is self-supporting, and (2) a straight extension ladder. Stepladders are typically used where it may be impossible to lean the ladder against a structure for support. On the other hand, an extension ladder is simply leaned against a wall or some other structure when standing or climbing on the ladder. Such ladders often include an extensible segment which can be used to telescopically extend the length of the ladder as desired.

Ladders which are constructed so that they may be used both as stepladders and as straight extension ladders are well-known in the art. See, e.g., U.S. Pat. Nos. 594,303; 1,100,823; 3,912,043; and 4,182,431. Typically, such ladders are constructed with hinges in the middle of the side rails. The hinges permit the ladder to be folded into a stepladder configuration or unfolded into a straight extension ladder configuration. As will be readily appreciated, combination step and extension ladders are very versatile and combine the desirable features of both types of ladders.

The combination step and extension ladders of the prior art are typically made of aluminum, steel, or other metal. While ladders constructed of such materials are suitable for most uses, the usefulness of a metal ladder near electrical currents is substantially limited. Because metal ladders are electrically conductive, the regulations of the Occupational Safety and Health Administration state that such ladders should not be used near live electrical wiring. For this and other reasons, the industry has long sought a suitable ladder, particularly a combination step and extension ladder, which can be made of a nonelectrically conductive material and which possesses the strength and stability necessary for use in construction and other industries.

Nonelectrically conductive materials used by those skilled in the art in the manufacture of a suitable ladder include various fiber/resin composites. To those skilled in the art, a "composite" is a material composed of fibers bonded in a resin matrix. Such composites are sometimes referred to (albeit imprecisely) by the generic term "fiberglass." (For convenience, the term "fiberglass" is sometimes used although it will be appreciated that other types of composites are equally applicable). Composites, such as fiberglass, have been found to be excellent materials for the making of such ladders, not only because of the nonelectrically conductive property of composites but also because they are excellent energy absorbing materials (as illustrated by their use in helicopter rotors and polevault poles).

Unfortunately, fiberglass is an isentropic material; that is, its properties depend to a significant extent upon the orientation of the fibers within the fiberglass material. For example, fiber orientation affects such properties as the transverse, bearing, tensile, compression, and flexural strengths of the resultant fiberglass material, as well as the stiffness of the fiberglass. Accordingly, the fiber orientation can drastically affect the ability of a ladder constructed of fiberglass to withstand the pressures and stresses of normal usage.

While ladders made of composite materials are known in the art, such ladders have generally been made through a process known as "pultrusion." In general terms, the pultrusion process includes coating the fibers with a resinous material and then pulling the fibers through a heated die where the fibers harden into the desired shape; typically, the die is heated with microwaves.

Unfortunately, the pultrusion method results in the fibers being unidirectionally oriented within the fiberglass material. Although the fiberglass material has excellent longitudinal strength when the fibers are unidirectional, such a fiberglass material also has low flexural, transverse, and bearing strengths. Hence, when a ladder is constructed of such a material, the side rails are ofttimes incapable of withstanding the transverse bending and twisting forces exerted during typical use. Moreover, problems have been encountered in attaching the rungs to side rails made of unidirectional fibers such that the side rails are capable of supporting the rungs during usage.

In an attempt to overcome, to a limited extent, the problems encountered in making a ladder from unidirectional fiberglass, those skilled in the art have substantially increased the thickness of the fiberglass material and have combined a nonoriented fabric with the resinous coated fibers in order to impart sufficient strength to the fiberglass. However, such techniques, particularly the increasing of the thickness of the fiberglass, have resulted in a ladder which is much heavier and more cumbersome to use; such a ladder is also much more expensive to construct.

In the manufacture of any type of ladder, it is desirable to flare the lower portions of the side rails, i.e., bend the lower portion of the side rails outwardly to increase the distance between the side rails at the base of the ladder. This improves the stability of the ladder. However, it is difficult to form the side rails with such a flared portion using the pultrusion process of the prior art.

As will be appreciated, the problems encountered by the prior art with respect to a fiberglass ladder are greatly exaggerated when the ladder is extensible, such as in a combination step and extension ladder. In such ladders, there are both inner and outer side rails which are formed such that the inner side rails can be telescopically moved and extended within the outer side rails and can be locked into position. With such extensible ladders, two particular problems exist: (1) how to lock the inner side rails into position with respect to the outer side rails, and (2) how to attach the ladder rungs between the inner side rails and between the outer side rails such that they do not interfere with each other, but yet are fixedly attached to the respective side rails.

In typical prior art metal ladders, the inner side rails are locked into position by inserting a pin or other clamping device into a hole formed in the inner side rails. However, the inherent bearing strength weakness of fiberglass (particularly the unidirectional fiberglass of the pultrusion process) requires modification of that clamping device. This inherent weakness also makes the attachment of the rungs to the fiberglass side rails difficult. With fiberglass side rails, the rungs cannot be simply welded to the edges of the side rails.

It would, therefore, be an improvement in the art to provide a ladder made of a composite material which is capable of overcoming the inherent bearing strength weaknesses of the prior art fiberglass. It would also be advantageous to provide a fiberglass combination step and extension ladder which may be extended to increase the height of the ladder in both the straight extension ladder configuration and in the step ladder configuration such that the rungs attached to the respective side rails are securely mounted and are capable of withstanding the stresses and pressures of normal use.

BRIEF SUMMARY AND OBJECTS OF THE INVENTION

The present invention is directed to a ladder constructed of a composite material, which is lightweight, nonelectrically conductive, and capable of withstanding the stresses and forces of normal use. Through the novel manufacturing method of the present invention, the fibers within the side rails of the ladder are oriented so as to overcome the inherent bearing strength weaknesses of the fiberglass material. These fibers are angularly oriented with respect to each other and with respect to the longitudinal axis of the side rails. The side rails are formed by a molding process in which a foam strip is molded within a portion of the fiberglass material along one edge of the side rail. This foam strip overcomes the inherent bearing strength weakness of the fiberglass material and increases the flexural and transverse strengths of the side rails so that the side rails are capable of withstanding the pressures and forces of use. The molding process of multidirectional fibers in combination with the foam strip also strengthens the fiberglass so that the side rails can be relatively thin and can be formed with a flared bottom portion for greater stability. The rungs are also configured to allow for a much greater bearing surface, which also helps to overcome the inherent bearing strength weakness of the fiberglass material and to allow the thickness of the fiberglass material to be substantially decreased.

Because the ladders of the present invention are made of composite materials, they are capable of being used under conditions where electricity may be present. Moreover, the design of the present invention provides for a lightweight and highly versatile ladder, such as a combination step and extension ladder. The fiberglass ladders of the present invention can therefore be used for a variety of construction and home purposes.

It is, therefore, a primary object of the present invention to provide for a lightweight, fiberglass ladder which can be used in the presence of electricity.

Another primary object of the present invention is to provide a method of manufacturing the siderails of a fiberglass ladder so that the fibers are angularly oriented with respect to the longitudinal axis of the side rails in order to increase the transverse bearing strength of the fiberglass material.

A further object of the present invention is to provide a method of manufacturing a fiberglass combination step and extension ladder such that the lower portion of the outer side rails may be flared to increase the stability of the ladder and such that the rungs may be attached to overcome the inherent bearing strength weaknesses of the fiberglass material.

A still further object of the present invention is to provide a lightweight fiberglass step and extension ladder which is extensible in both the step ladder configuration and the extension ladder configuration.

These and other objects and features of the present invention will become more fully apparent from the following description and appended claims taken in conjunction with the accompanying drawing.

DETAILED DESCRIPTION OF THE PREFERRED EMBODIMENT

Figure 1:
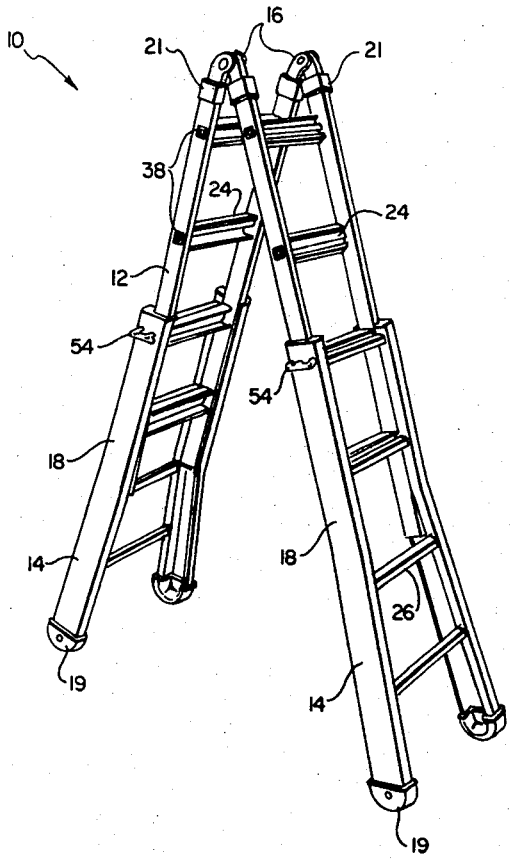
FIG. 1 is a perspective illustration of a combination step and extension ladder within the scope of the present invention wherein the ladder is folded into the step ladder configuration and is partially extended.

The invention is best understood by reference to the drawing wherein like parts have like numerals throughout. Although the embodiment of the present invention hereinafter discussed is that of a combination step and extension ladder, it will be appreciated that the structure and method of manufacturing disclosed may be applied to other types of ladders made of composite materials, such as a stepladder or an extension ladder.

Figure 2:
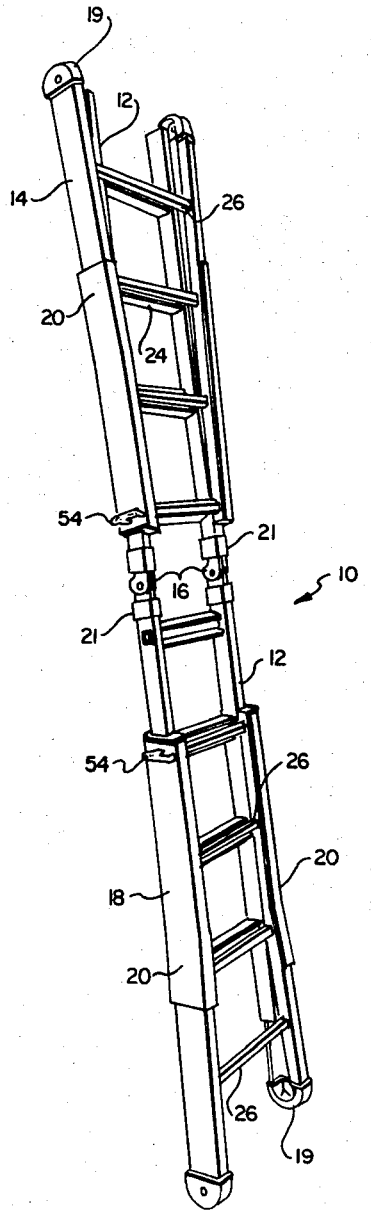
FIG. 2 is a perspective illustration of a combination step and extension ladder within the scope of the present invention wherein the ladder is unfolded and partially extended in the extension ladder configuration.

In FIG. 1, the combination step and extension ladder, generally designated 10, is shown folded in the step ladder configuration. In FIG. 2, ladder 10 is shown unfolded in the extension ladder configuration. Ladder 10 is constructed from four pairs of side rails; the side rails of a ladder are sometimes referred to as "stringers" by those skilled in the art. Inner side rail pairs 12 are hingedly connected at one end by hinges 16. Hinges 16 may be locked into a number of different positions, thus providing a variety of ladder configurations. At their other end, side rail pairs 12 are each slidably mounted in telescopic relation within outer siderail pairs 14. Each of the side rail pairs 12 may independently be telescopically extended in either the stepladder (see FIG. 1) or the extension ladder (see FIG. 2) configurations. By providing for independent extension of either of the side rail pairs 12, a stepladder of varying heights and varying angles can be formed, thereby increasing the versatility of ladder 10. To improve the stability of the ladder, outer side rail pairs 14 are slightly bent outwardly or flared at 18, and are provided with nonskid shoes 19.

Two sets of ladder rungs, generally designated 24 and 26, are provided. Ladder rungs 24 are mounted between inner side rail pairs 12, while ladder rungs 26 are mounted between outer side rail pair 14.

Each of the side rail pairs 12 and 14 are fabricated of a fiberglass material, thereby resulting in a ladder which is substantially nonelectrically conductive. Hence, the ladders of the present invention may be safely used near live electrical wiring.

As discussed above, those skilled in the art have encountered several significant problems in constructing a versatile, lightweight, fiberglass ladder according to prior art methods. One feature which significantly contributes to the feasibility of the present invention is the orientation of the fibers within the fiberglass material of the side rails. A proper orientation of the fibers increases the strength and stability of the side rails such that the fiberglass does not have to be as thick as has heretofore been required in order for the ladder to be capable of withstanding the pressures and stresses of normal use.

It has been found that the inherent flexural, bearing, and transverse strength weaknesses of the unidirectional fiberglass of the prior art can be overcome by angularly orienting the fibers in the fiberglass with respect to the longitudinal axis of the respective side rail. In order to achieve this angular orientation of the fibers, it is necessary to use a molding process to form the fiberglass parts of the ladder instead of a pultrusion process.

According to the method of manufacturing the present invention, fiber strands are saturated with a catalyst-containing resin and then wound around a cylindrical drum or mandrel. The orientation of the fibers in the resultant product is determined by the angle at which the fibers are wound about the drum. The fibers are deposited upon the circumferential surface of the drum in successive layers which each contain a multiplicity of helical turns of fibers extending continuously from one end to the other end of the drum. The fibers are deposited so as to transverse in one direction along the drum and then in the opposite direction. The successive layers of resinous coated fibers form a fiberglass winding lay up in which the layers of fibers lie in a criss-crossed or "X" relationship.

After the formation of a winding lay up of the desired thickness, the winding lay up is removed (while still in the "green" or uncured condition) from the drum and cut into long, narrow strips from which the side rails are molded. By winding or depositing the fibers on the drum at a predetermined angle and then appropriately cutting the lay up into strips, it is possible to orient the criss-crossed fibers within the fiberglass so that they will form a specified angle with respect to the longitudinal axis of the side rail which is molded.

Figure 5:
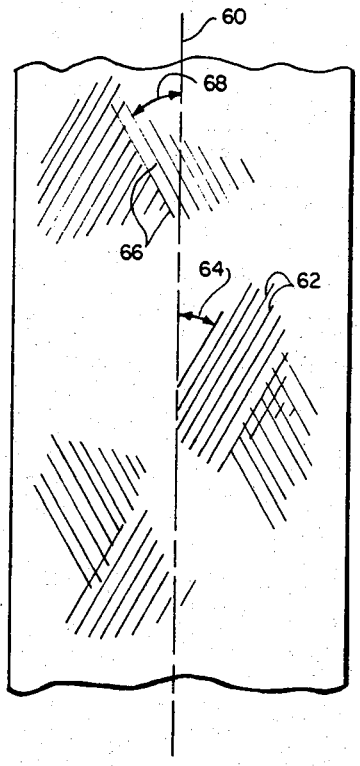
FIG. 5 is a front elevational view of a piece of fiberglass material in which the orientation of the fibers is illustrated prior to the material being molded into a side rail of the present invention.

FIG. 5 illustrates a piece of fiberglass material prior to the molding step and how the fibers in that material are preferably angularly oriented. Line 60 represents the longitudinal axis of the side rail (after the fiberglass has been molded into that form). A series of substantially parallel fibers 62 form an angle 64 with respect to longitudinal axis 60, and another series of substantially parallel fibers 66 form an angle 68 with respect to longitudinal axis 60. Fiber 62 is formed by the winding of one layer of fibers in a helical pattern about the drum and fibers 66 are formed by the winding of a next layer of fibers in an opposite helical pattern about the drum. As illustrated in FIG. 5, angle 64 is preferably substantially equal to angle 68. When the fibers are thus angularly positioned, a homogeneous-type material having more uniform strengths in all directions is produced.

Any fiber conventionally used in the manufacture of composites, including glass, aramid, or graphite, may be used in the process of the present invention. Because of economic considerations, the presently preferred fiber is a type "E" glass fiber, which is well-known to those in the art. However, an organic aramid fiber, such as sold by E. I. duPont de Neumours & Co. under the trademark "Kevlar 49", is particularly desirable when a stiffer or lighterweight material is desired. The strength-to-weight ratio of a composite made from Kevlar 49 is particularly high.

A variety of different conventionally used resins are acceptable, including several polyesters such as an isothalic polyester. Again, a variety of well-known catalysts could be used, but benzoyl peroxide is presently preferred because it does not catalyze the resin until an elevated temperature during the molding process is achieved.

It will be appreciated that the fiber orientation angle (angles 64 and 68) may be varied depending upon the particular pressures and stresses which will be exerted upon the fiberglass in a specific application, as well as the type of fibers and resin used in the fiberglass ladder. For example, the smaller the fiber orientation angle, the greater the strength in the longitudinal direction; the larger the fiber orientation angle (which preferably should not significantly exceed about 45 degrees), the greater the bearing and transverse flexural strengths. Hence, a relatively larger angle is preferable for outer side rails 14 which must support or bear the greater weight and which are subjected to greater transverse and flexural forces. On the other hand, most of the forces exerted on inner side rails 12 are longitudinal, and thus a smaller angle may be sufficient. Angles of about 10 to 25 degrees are presently preferable for the fiberglass material used in inner side rails 12 and angles of about 15 to 35 degrees are presently preferable for use in the fiberglass material used in outer side rails 14.

Economic and other manufacturing considerations may also dictate the fiber orientation of the composite material. For example, it may be desirable to make some compromise in the preferable fiber orientation angle so that both the inner and outer side rails can be made of the same fiberglass material. Because of purely economical considerations, it may be more desirable to make the inner rail of a thicker fiberglass winding lay up and to use the pultrusion method of manufacture, since most of the forces exerted on inner side rails 12 are in the longitudinal direction.

Figure 4:
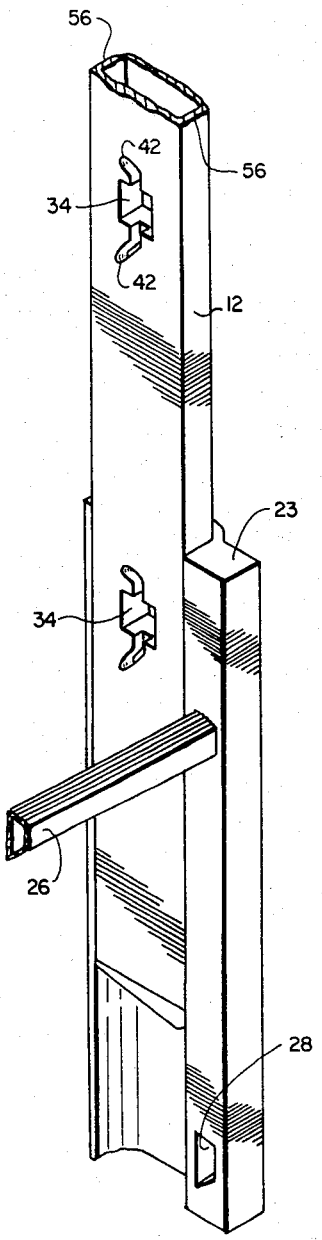
FIG. 4 is a fragmentary perspective illustration particularly showing the inner and outer side rails of a ladder of the present invention.

Each outer side rail 14 has a "C" shaped channel which slidably receives a corresponding inner side rail 12. As is best shown in FIG. 4, side portion 23 of each "C" shaped rail 14 is significantly thicker than is the remainder of the side rail. Thickened portion 23 is provided for mounting ladder rungs 26 to outer side rails 14.

Figure 6:
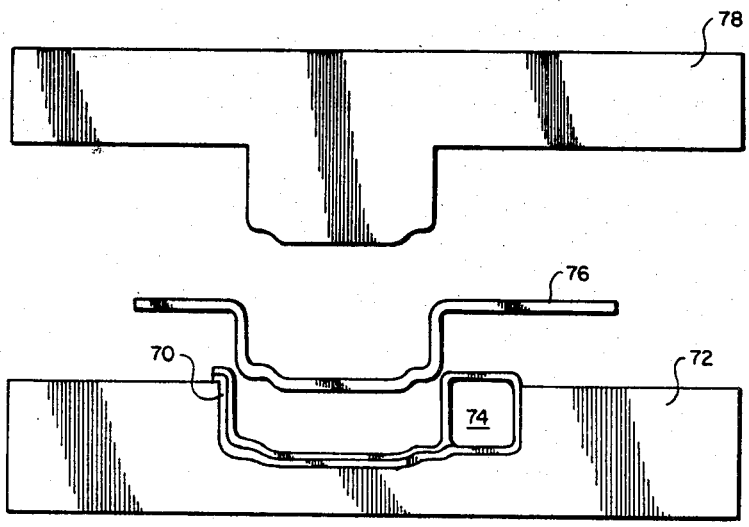
FIG. 6 is a cross-sectional view of the molding apparatus used in the process of molding the outer side rails of the present invention.

To mold outer side rail 14, a long narrow strip of "green" fiberglass winding lay up 70 (the fibers having been oriented as hereinbefore discussed) is placed into female mold 72 as illustrated in FIG. 6 so as to generally conform to the configurations of the mold. A long rectangular strip of foam 74 is then placed on top of lay up 70 at one side of the mold 72. The remaining portion of lay up 70 is folded around foam strip 74 and then placed on top of the portion of the lay up 70 previously placed in the mold. As depicted in the figure, a double thickness of lay up 70 preferably forms the "C" shaped channel of each outer side rail and a single thickness of fiberglass surrounds foam strip 74. Caul sheet 76 is then placed upon fiberglass winding lay up 70 to minimize movement of lay up 70 when male mold 78 is brought into mating relationship with female mold 72. It will be appreciated that other conventional molding techniques, such as using a preform or an expanding cavity mold, which form the side rails in the discussed shape, may be used.

The fiberglass is subjected to elevated temperature and pressure conditions in order to cure and harden the fiberglass into the desired shape. The elevated temperature activates the catalyst which causes the resin to harden. Using the preferred fibers, resins, and catalysts discussed above, the molding process can be accomplished in a commercial manufacturing setting by subjecting the fiberglass lay up 70 to pressures of about 100 to 200 psi at a temperature of about 300° F. for about 2 minutes. Of course, there is considerable flexibility within the level of skill in the art as to precise temperature and pressure conditions used.

The preferred foam of foam strip 74 is a closed-cell foam having a density of about 3 to 4 pounds per cubic foot, although other densities may be suitable. Foams made from polyvinylchloride, polyurethane, or a similar material are satisfactory.

It will be appreciated that a significant feature in the design of outer side rail 14 is the molding of foam strip 74 within the fiberglass material. The combination of the fiberglass and the foamstrip and their respective properties allows for the easy and secure mounting of ladder rungs 26 to the outer side rails. As best shown in FIG. 4, aperture 28 is routed in thickened portion 23; aperture 28 may or may not extend completely through the thickened portion of the side rail depending upon the weight which the ladder rung must support.

An end of ladder rung 26, which is preferably formed of extruded aluminum, is inserted into aperture 28 and any suitable adhesive is used to securely hold the rung in place. For convenience of manufacturing, room temperature set epoxy or hot melt thermoplastic adhesives are preferable.

It will be appreciated that the closed-cell foam strip (74 in FIG. 6) provides a great improvement over fiberglass ladders found in the prior art in that the weight being supported by ladder rung 26 is distributed over several surface areas of the side rails. The ladder rung is supported by (1) an edge of the fiberglass (along the edge of aperture 28 which is cut in thickened portion 23), (2) a surface of the foam strip along the lower portion of aperture 28, and (3) the adhesive which bonds the ladder rung to the side and upper fiberglass and foam surfaces inside aperture 28. (If additional support is necessary, aperture 28 could be formed completely through thickened portion 23 so that another edge of fiberglass, as well as a support means attached to the exterior of the side rail, may be used to support the rung.)

By using such a combination of bearing surfaces of foam and composite material to support the rungs, the inherent bearing strength weaknesses of the fiberglass material are overcome. This structure also allows for a much thinner piece of fiberglass to be used, thereby reducing the total weight of the ladder without reducing the ability of the side rails to support adequate loads. In fact, by using this configuration, the thickness of the fiberglass mat used in the molding operation can be as thin as about 0.05 inches when type "E" glass fibers are used.

Another advantage of the method of manufacture of the present invention over prior art methods, particularly the pultrusion method, is that outer side rails 14 can be formed such that the lower portion is slightly bent outwardly or flared, as shown at 18 in FIG. 1, to increase the distance between side rails 14 at their base and thereby improve the stability of the ladder.

When outer side rails 14 are made as described above, they are capable of supporting the weights normally encountered even though the lower portion is flared. Nevertheless, it may be desirable to provide reinforcement for purposes of safety. If such reinforcement is desired, outer side rails 14 may have a reinforcing piece 20 (made of fiberglass) molded to the upper portion and portion 18 of the side rails, as is illustrated in the embodiment of the present invention depicted in FIG. 2. When the lower portions of the side rails are spaced apart, greater pressure is exerted at bent portion 18 and the side rail portion thereabove. The reinforcing effect of piece 20 is increased if the orientation of the fibers in the fiberglass of piece 20 is perpendicular to the orientation of the fibers in the fiberglass of side rails 14.

Hinges 16, which connect side rail pairs 12, are spring-loaded locking mechanisms (not shown) which permits the combination step and extension ladder to be locked into any of several positions. For example, the locking mechanism may be released and the ladder 10 may be unfolded and then relocked into the straight extension ladder position as shown in FIG. 2. Ladder 10 may also be folded so that the side rail pairs on the opposite sides of hinges 16 lay flat against each other when it is desired to store the ladder 10 in a confined area. Hinges such as those illustrated in the preferred embodiment are available through Little Giant Industries, Inc., 31 West 100 South, American Fork, Utah. Other types of hinges are known in the art and any suitable type of hinge could be substituted for hinges 16.

The hinges are fixedly attached within the upper ends of inner side rails 12, which are preferably hollow so as to minimize the weight of the ladder. The hinges are best secured within side rails 12 by use of both an adhesive and rivets. Any suitable and convenient adhesive, such as those mentioned above, may be used. To reinforce the hinge within side rails 12, it is advantageous to mold a second piece of fiberglass or "doubler," designated as 21, around the upper end of the side rail into which the hinge is secured. As with reinforcing piece 20, the fibers of doubler 21 are preferably perpendicularly oriented with respect to the fibers of the inner side rail.

Inner side rails 12 are also preferably molded from "green" fiberglass winding lay ups. Inner side rails can be molded using any of a number of conventional techniques. For example, the fiberglass winding lay up can be placed around a preform and then molded into shape by pressure and heat. When this technique is used, it may be desirable, although not essential, to form the narrow sides (designated at 56 in FIG. 4) of a double thickness of fiberglass. This strengthens sides 56 which are significant stress areas. Alternatively, the inner side rails could be molded in two "C" shaped sections which are then adhesively secured together to form the rectangularly hollow side rail. Using this technique, the side portions of the side rail are automatically double thickness.

Figure 3:
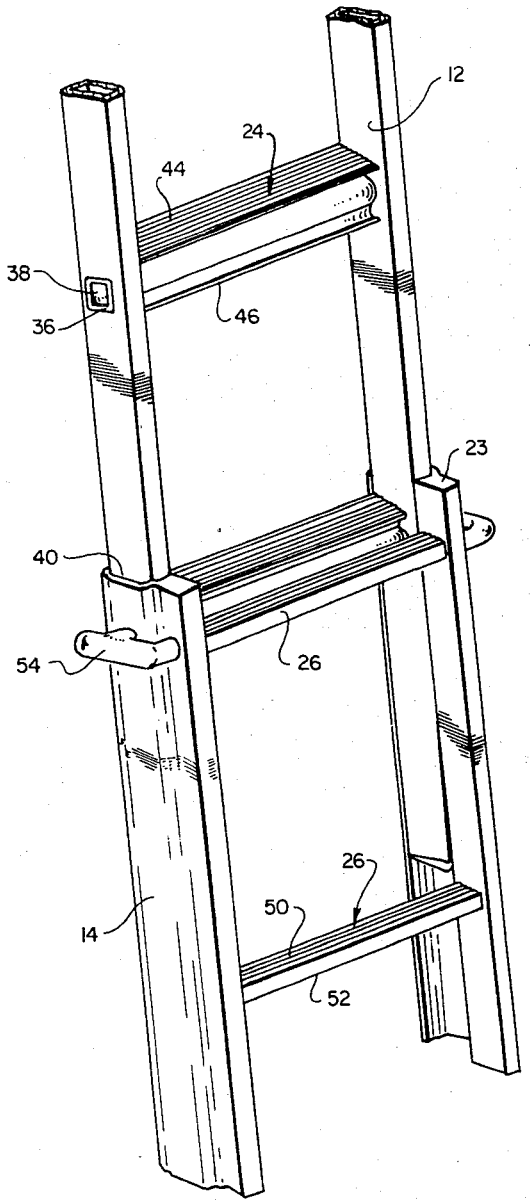
FIG. 3 is a fragmentary perspective illustration particularly showing the construction of the ladder rungs of a ladder of the present invention.

As shown best in FIG. 3, ladder rungs 24 are mounted between inner side rails 12. Ladder rungs 24 are also preferably formed of extruded aluminum. Each ladder rung 24 has a tubular bar portion 32 which extends between side rails 12. Tubular bar 32 is long enough to extend through apertures 34 (shown in FIG. 4) which are formed in inner side rails 12. Each end of tubular bar 32 extends through the respective aperture 34 beyond the exterior surface of side rails 12. The tubular bar is then swaged against the outside surface of side rails 12 to form a smooth end, generally designated 36, which holds the tubular bar in position. Swaged end 36 also helps to spread the pressure, which is essentially on the edges of fiberglass formed by lower surface aperture 34, around the side and top edges of aperture 34. To allow for inner side rails 12 to reciprocate within the "C" shaped outer side rails 14, it is desirable to form outer side rails 14 with a groove 40 to allow for clearance of swaged ends 36 of the tubular bar which extend beyond the exterior surface of the inner side rails.

Tubular bar 32 is preferably hollow (see FIG. 3), thereby forming holes 38 along the outside surfaces of side rails 12. Holes 38 provide incremental positions at which side rails 12 may be locked into position when side rails 12 are telescopically extended. A locking mechanism 54 may be mounted on outer side rail pairs 14 so that it can engage holes 38, thereby securing side rail pairs 12 and 14 with respect to each other. While any suitable locking mechanism may be used, the handle and pin locking mechanism of U.S. Pat. No. 4,182,431 (which is hereby incorporated by reference) is preferred. Such a mechanism advantageously permits the ladder to be extended both when it is in the stepladder configuration and when it is in the extended ladder configuration.

It will be seen that ladder rungs 24 are formed to preferably have two flat stepping surfaces 44 and 46. Stepping surface 44 faces upwardly while stepping surface 46 faces downwardly. Both stepping surfaces are preferably integrally formed as a part of tubular bar 32. In order to distribute the pressure exerted by stepping surfaces 44 and 46 and tubular bar 32 on side rails 12 and to prevent twisting of the stepping surfaces, it has been found advantageous to form side rails 12 with recesses 42 therein. As shown best in FIG. 4, recesses 42 are not holes in the inside wall of side rails 12, but are recessed areas which are formed during the molding process to correspond to and to receive the ends of stepping surfaces 44 and 46. It will be appreciated that a portion of the pressure exerted on each stepping surfaces 44 or 46 is distributed onto insert 42 and another portion of the pressure is received by the fiberglass edges of hole 34 of the inside wall and the outside wall of side rail 12. Stepping surfaces 44 and 46 are preferably symmetrically angularly oriented, as illustrated in the figures, in order to provide a horizontal stepping surface whether the latter is used as a step or as an extension ladder.

With reference to FIG. 3, it will be seen that ladder rungs 26, which are mounted between outer side rails 14, each have a generally trapezoidal cross-sectional shape. Stepping surfaces 50 and 52 are angled so as to be essentially coplanar with the stepping surfaces 44 and 46 of ladder rungs 24. When vertically aligned, ladder rungs 24 and 26 jointly form upper and lower stepping surfaces which are coplanar and which are angularly oriented with respect to the side rail pairs so that whenever the ladder is placed in an upright position, either in the step ladder configuration or in the straight extension ladder configuration, a horizontal stepping surface will be formed by the stepping surfaces 44 and 50, or 46 and 52, of the two ladder rungs 24 and 26. Serrations may be formed on each of the stepping surfaces to prevent slipping.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for making a ladder from composite materials having a first pair of side rails slidably mounted in telescopic relation within a second pair of side rails, the steps of the method comprising:

winding strands of resin-saturated fibers on a cylindrical drum such that the fibers are angularly oriented with respect to each other, thereby forming a sheet about the drum comprising at least one layer of resin-saturated fibers;

removing the sheet of resin-saturated fibers from the cylindrical drum;

cutting the sheet into long narrow strips such that the fibers are obliquely oriented with respect to a longitudinal axis of said strips;

placing the strips into molds corresponding to the side rails of said first and said second side rail pairs such that the longitudinal axis of each strip is parallel to a longitudinal axis of the respective mold; and heating the resin-saturated fibers in the mold under pressure to a temperature sufficient to harden said fibers.

2. A method for making a ladder from composite materials as defined in claim 1 wherein the placing step further comprises the steps of:

placing a form strip on a portion of each of the resin-saturated strips in the molds corresponding to the side rails of the second side rail pair such that said foam strip is in parallel alignment with the longitudinal axis of the side rails of said second side rail pair; and folding a portion of each strip of resin-saturated fibers such that the strip surrounds the foam strip.

3. A method for making a ladder from composite materials as defined in claim 1 wherein the winding step comprises winding the strands of resin-saturated fibers on the cylindrical drum at an angle of between about 65 and about 80 degrees from a longitudinal axis of the cylindrical drum for the sheet which is to be used for the first pair of side rails and at an angle between about 55 and about 75 degrees from a longitudinal axis of the cylindrical drum for the sheet to be used for the second pair of side rails.

4. A method for making a ladder from composite materials as defined in claim 1 wherein said placing step comprises placing the strips of resin-saturated fibers into the mold for the second pair of side rails such that the second pair of side rails are flared outwardly at their lower portion.

5. A method for making a ladder from composite materials as defined in claim 1 wherein the mold for said second pair of side rails has a C-shaped channel such that said first pair of side rails is slidably mounted in said C-shaped channel in telescopic relationship to said second pair of side rails.

* * * * *